United States Patent [19]

Thomas et al.

[11] 4,367,760

[45] Jan. 11, 1983

[54] COIN DISPENSER MADE WITH ADJUSTABLE HEIGHT STRUCTURE

[76] Inventors: Kim Thomas, 51 Thirkleby Close, Slough (Berkshire), England; Wilhelm A. Van Zeggeren, Van Goghlaan 18, Bleiswijk, Netherlands

[21] Appl. No.: 212,715

[22] PCT Filed: Feb. 29, 1980

[86] PCT No.: PCT/US80/00202

§ 371 Date: Nov. 3, 1980

§ 102(e) Date: Nov. 3, 1980

[87] PCT Pub. No.: WO80/01852

PCT Pub. Date: Sep. 4, 1980

[30] Foreign Application Priority Data

Mar. 1, 1979 [GB] United Kingdom ..... 7907251

[51] Int. Cl.[3] ..... G07D 1/02

[52] U.S. Cl. ..... 133/4 A; 133/5 R

[58] Field of Search ..... 133/4 R, 4 A, 5 R, 5 B, 133/1 R, 1 A, 5 A, 8 R, 8 B, 8 A, 8 D; 221/142

[56] References Cited

U.S. PATENT DOCUMENTS

| | | | |
|---|---|---|---|
| 1,105,516 | 7/1914 | Hoefer | 133/4 R |
| 1,385,360 | 7/1921 | Bruhn et al. | 133/5 B |
| 2,629,477 | 2/1953 | May | 133/4 R X |
| 3,822,713 | 7/1974 | Frahm et al. | 133/2 |
| 3,841,341 | 10/1974 | Englund et al. | 133/4 |
| 4,250,905 | 2/1981 | Kobayashi et al. | 133/5 R |
| 4,266,564 | 5/1981 | Coburn et al. | 133/5 R |

FOREIGN PATENT DOCUMENTS

| | | |
|---|---|---|
| 707563 | 4/1965 | Canada . |
| 831847 | 1/1970 | Canada . |
| 1086471 | 8/1960 | Fed. Rep. of Germany . |
| 318926 | 12/1930 | United Kingdom . |
| 901815 | 7/1962 | United Kingdom . |
| 931505 | 7/1963 | United Kingdom . |
| 1134115 | 11/1968 | United Kingdom . |
| 1137059 | 12/1968 | United Kingdom . |
| 2009479 | 6/1979 | United Kingdom . |

*Primary Examiner*—Stanley H. Tollberg

*Attorney, Agent, or Firm*—Davis, Hoxie, Faithfull & Hapgood

[57] ABSTRACT

The invention relates to a coin dispenser for use in vending machines for giving out change when the value of money inserted into the machine exceeds the price of the merchandise purchased. The aim of the invention is to simplify the design of such a dispenser so that different sets of coins can be catered for from a small range of parts.

The dispenser comprises vertical coin tubes (12,13,14), one for each denomination of coin dispensed, and respective channels (15,16,17) extending horizontally beneath each tube. Each channel has an aperture (21,22,23) in its lower wall offset from the axis of the tube, (12,13,14) and an apertured slide plate (24,25,26) is movable in the channel (15,16,17) from below the coin tube (12,13,14) to over the aperture (21,22,23) in the lower wall so as to dispense the coins singly from the stacks in the coin tubes.

The coin tubes extend down through apertures (18,19,20) in the upper wall of their respective channels so that the lower end of the tubes are the lowest point in the coin channels. With this arrangement a range of denominations of coins of differing thicknesses can be catered for by setting the lower end of the tube at a height appropriate to the thickness of the denomination of coins during assembly.

17 Claims, 5 Drawing Figures

COIN DISPENSER MADE WITH ADJUSTABLE HEIGHT STRUCTURE

The present invention relates to a coin dispenser for use in vending machines for giving out change when the value of money inserted into the machine by a customer exceeds the price of the merchandise purchased.

The usual arrangement for dispensing coins is a vertical coin tube which contains a stack of coins of a single denomination. A channel extends horizontally beneath the lower end of the tube and has an upper wall with an aperture aligned with the coin tube and a lower wall with an aperture disposed over a change dispensing passageway. The aperture in the lower wall is offset from the vertical axis of the coin tube so that coins in the coin tube cannot fall directly through the aperture in the lower wall. A slide plate is disposed in the channel and serves to transfer coins from the bottom of the stack in the coin tube to the aperture in the lower wall. A slide plate is disposed in the channel and serves to transfer coins from the bottom of the stack in the coin tube to the aperture in the lower wall. The plate has circular apertures for receiving coins from the stack. The plate can be slid back and forth in the channel between a position in which the aperture in the plate is below the coin tube and there receives a coin from the tube and a position in which it is over the aperture in the lower wall from where the coin falls into the dispensing passageway. The height of the channel is between one and two coin thicknesses so that only one coin at a time can be dispensed. A machine which dispenses more than one denomination of coin as change will have such an arrangement for each denomination of coin.

For the dispenser described above to work reliably the dimensions of the dispenser must closely correspond to the diameter and thickness of the particular denomination of coin being dispensed. This means that the manufacturer of such dispensers for several countries offer a large number of different sizes of mechanism to suit the large variety of sizes of coins in use.

The aim of the present invention is to simplify the design of a coin dispenser so that different sets of coins can be catered for using a small range of parts.

According to the present invention a coin dispenser comprises a channel, an aperture in the upper wall of the channel, a coin tube extending down through the aperture in the upper wall of the channel the lower end of the tube projecting down below the level of the upper wall of the channel, an aperture in the lower wall of the channel offset from the axis of the tube, an apertured slide plate-mounted for reciprocating movement in the channel and means mounting the coin tube with its lower end a predetermined height above the lower wall of the channel.

By using the lower end of the coin tube to form the lowest point on the coin channel the individual slide plates and channels do not have to be made to suit the individual thickness of coins: it is possible to use one size of channel and slide plate to serve a large number of different sizes of coins. The slide plates and channels are used in combination with coin tubes selected from a range of different sizes of coin tubes and the mounting means are used to mount the selected coin tubes at the appropriate height for the particular thickness of coins being used. Thus for the manufacturer the number of different parts needed to meet the requirements of customers in different countries can be substantially reduced. Whilst the mounting means must be made to suit the particular denomination of coins being used, by making inexpensive mounting plates for each coin set, or by assembling the tubes in predetermined positions on a standard mounting plate, for example by using a different mounting jig for each coin set, and staking in position, the part which has the largest number of variants for the mounting plates is expensive to produce or assemble.

An embodiment of the invention will now be described, by way of example, with reference to the accompanying drawings, of which:

Figure 1:
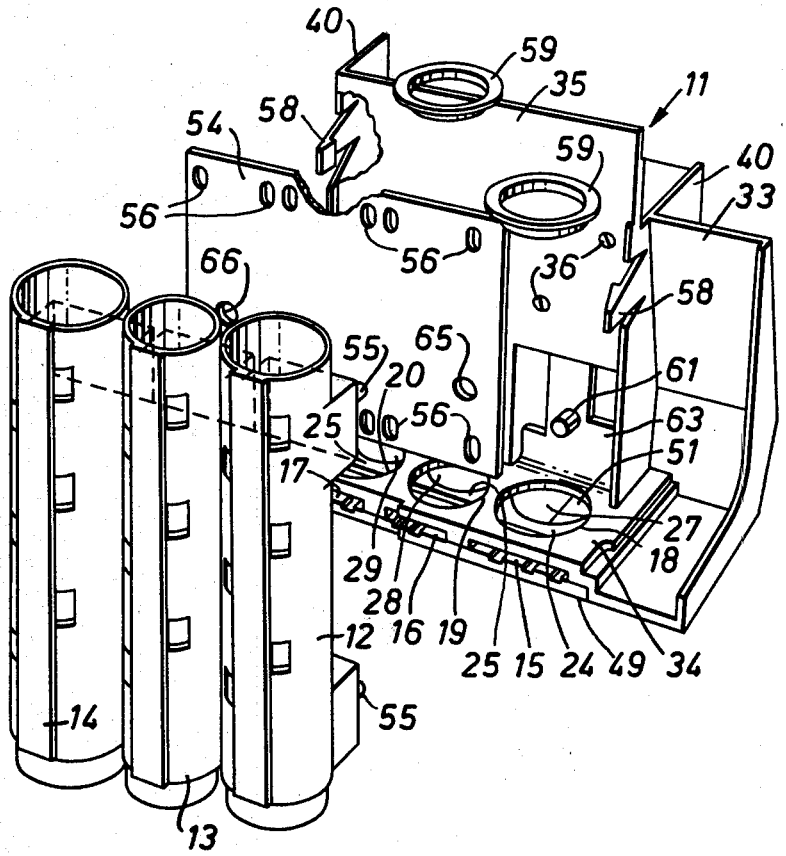
FIG. 1 shows an exploded perspective view of a coin dispenser according to the invention.
Figure 2:
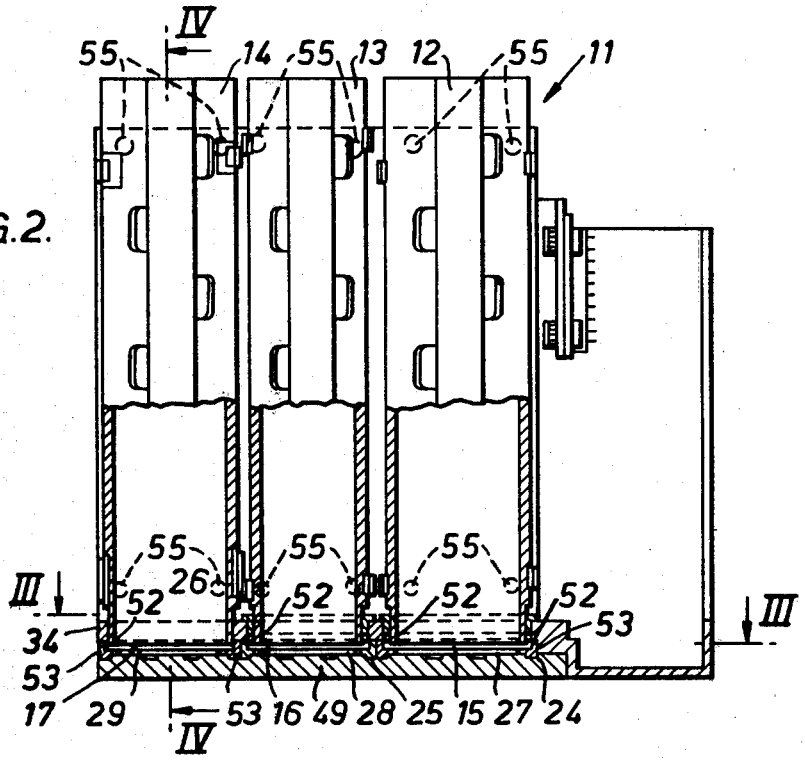
FIG. 2 shows a front view, partly in section, of the coin dispenser of FIG. 1.
Figure 3:
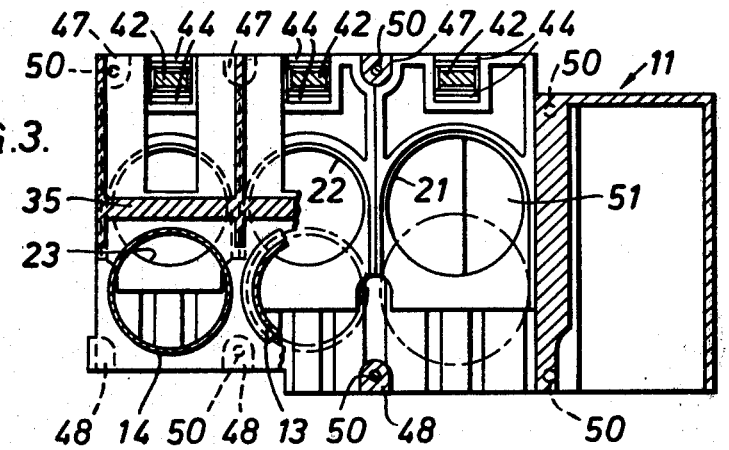
FIG. 3 shows a horizontal section of the coin dispenser taken on the line III—III of FIG. 2.

The drawings show a coin dispenser 11 for dispensing three denominations of coins. The dispenser 11 includes three vertical coin tubes 12, 13 and 14 of moulded plastics, one for each denomination of coin. The coin tubes hold the coins in vertical stacks.

Beneath each of the coin tubes 12, 13 and 14 a respective channel 15, 16 and 17 extends horizontally. In the upper wall of each channel is an aperture 18, 19 and 20 through which the lower end of the coin tube 12, 13 and 14 extends. In the lower wall of each channel and out of alignment with the coin tube 12, 13 and 14 is an aperture 21, 22 and 23 leading to a coin dispensing passage (not shown). The coin dispensing passage leads to a receptacle which is accessible to a customer outside the machine in which the dispenser is housed so that the customer may collect the change dispensed.

A slide plate 24, 25 and 26 is disposed in each channel 15, 16 and 17. The plates each have an aperture 27, 28 and 29 for receiving coins from their associated tubes 12, 13 and 14. The slide plates 24, 25 and 26 are movable between positions in which the apertures in the plates are below their respective coin tubes and positions in which they are above their respective apertures in the lower walls of the channels by means of three solenoid actuators 30, 31 and 32.

The coin dispenser is made up from a base member 33 of moulded plastics material to which all other parts are secured. The base member comprises a horizontal plate 34 which forms the upper walls of the channels 15, 16, and 17 and contains the three apertures 18, 19 and 20. The base member also comprises a vertical plate 35 to the back of which are secured the solenoid actuators 30, 31 and 32 by means of screws 36.

Figure 4:
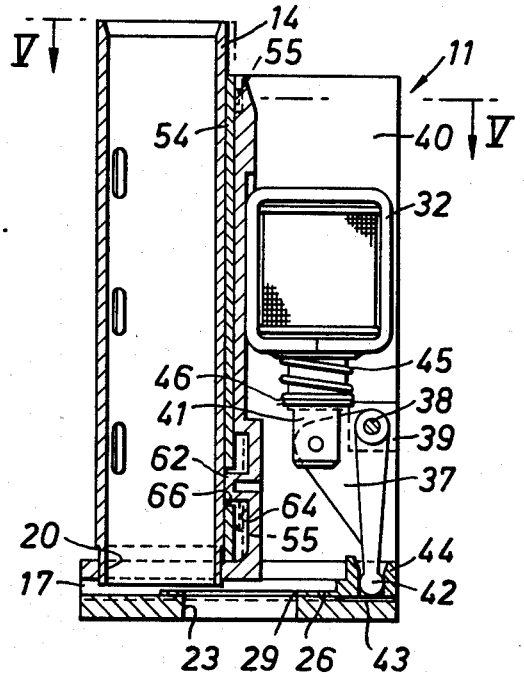
FIG. 4 shows a vertical section of the coin dispenser taken on the line IV—IV of FIG. 2.
Figure 5:
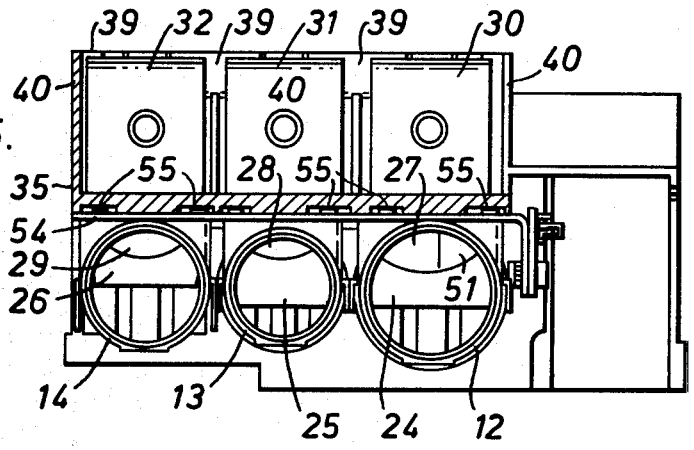
FIG. 5 shows a plan view partly in section of the coin dispenser taken on the line V—V of FIG. 4.

As can be seen in FIG. 4 each solenoid actuator includes a bell crank lever 37 of moulded plastics material which is pivoted on a rod 38 which passes through lugs 39 carried by partition walls 40 moulded on the base member 33. The armature 41 of the solenoid actuator is pivotally connected to the bell crank lever 37. A leg 42 moulded or the lower end of the lever 37 sits in a slot 43 between two upstanding projections 44 at the rear of the slide plate 24, 25 or 26. A spring 45 is wound around the armature of the solenoid actuator and acts between the casing of the solenoid and a flange 46 on the armature to urge the armature into the extended position. In this position the bell-crank lever 37 is fully rotated in the anti-clockwise direction and the leg 42 holds the slide at the right hand end of its travel as shown in FIG. 4. Movement of the slide plates towards the rear is limited by abutment with the dispenser enclosure (not shown). When the solenoids are energised the armatures are retracted against the action of the springs 45, the bell crank levers 37 are rotated in the clockwise direction and the legs 42 engaging the slots 43 push the slide plates forward until the apertures 27, 28 and 29 in the plates are below the coin tubes 12, 13 and 14 respectively when the slide plates abut bosses 48 on the underside of the plate 34 or, alternatively, when projections 44 abut the horizontal plate 34. The solenoids are immediately de-energized and the slides return to the back of the channels under the action of the springs 45.

The lower walls of the channels 15, 16 and 17 are formed by a moulded plastics plate 49 which is secured to the underside of the plate 34 by screws 50. The bosses 47 and 48 serve as spacers to space the plate 49 from the plate 34. The plate 49 is spaced from the plate 34 by a distance at least as great as the thickness of the thickest coin which the dispenser may be required to dispense. The plate 49 contains the apertures, 21, 22 and 23. Two of the apertures are of the same diameter, one, 21, is larger but is partially covered on one side by a moulded web 51, the upper surface of which slopes down towards the chordal edge. The web 51 covers almost half of the area of the aperture 21. The diameter of the apertures 27, 28 and 29 in the slide plates match the diameters of the holes in the plate 49.

When the coins from the tube 12 are moved by the slide 24 to the aperture 21 they drop into the recessed upper part of the aperture and then slide down the inclined upper surface of the web 51 and through the open part of the aperture into the dispensing passageway. The web 51 serves to deflect coins dispensed through the aperture 21 into a defined coin-return area. Grooves 52 running from front to back are formed in the upper surface of the plate 49 and engaged by runners 53 on the underside edges of the slide plates 24, 25 and 26 to guide the plates for rectilinear sliding movement in the channels.

The coin tubes 12, 13 and 14 are mounted on a plastics mounting plate 54. Each tube has two pairs of pegs or studs 55 moulded on it which are received in corresponding pairs of holes 56 drilled in the plate. The tubes are of different diameter, but the horizontal and vertical spacing of the pegs is identical for every tube, such that any tube may be assembled into any one of the three locations in the mounting plate.

The peg holes in the mounting plate are slotted vertically to allow adjustment of the tube position so that the lower end of each tube is at the correct height above the lower wall of the channel when the dispenser is assembled.

The correct height is between one and two coin thicknesses so that coins are dispensed singly.

Once the coin tubes have been assembled on the plate and their positions adjusted, they are secured in place by collapsing the pegs as by ultrasonic melting to fill the slots completely and form mushroom-shaped heads.

Pegs or studs 61, 62 located in recessed pockets 63, 64 protrude beyond the planar surface of vertical plate 35 and are received in close-fitting holes 65, 66 drilled in mounting plate 54. Pegs 61, 62 and holes 65, 66 serve to position accurately the sub-assembly of plate 54 and the coin tubes with respect to vertical plate 35.

The sub-assembly of tubes and mounting plate is secured on the vertical plate 35 by two hooks 58 which are moulded integrally with the outer two partition walls 40. The lower ends of the tubes extend through into the apertures 18, 19, 20, and a packing ring 59 may be inserted between the lower ends of the smaller tubes and the aperture 18 to provide further stability.

We have found it possible to build dispensers for the coin sets of three different coins of the major currencies of the world from a single size of sub-assembly of base-member 33, bottom plate 49, slide plates 18, 19, 20, solenoid activators 30, 31, 32, tube mounting plate 54 and a range of up to six different sizes of coin tubes.

In this particular dispenser the tubes are selected from five having the following dimensions:

| TUBE NO. | INTERNAL DIA. |
|---|---|
| 1 | 29.5 |
| 2 | 24.5 |
| 3 | 21.5 |
| 4 | 19.5 |
| 5 | 17.5 |

The slides have the following dimensions:

| SLIDE PLATE | APERTURE DIA. | THICKNESS |
|---|---|---|
| 24 | 29.85 | 1.15 |
| 25 | 21.85 | 1.1 |
| 26 | 24.85 | 1.1 |

The bottom plate has the following aperture diameters:

| BOTTOM PLATE | APERTURE DIA. |
|---|---|
| 21 | 30.3 |
| 22 | 22.3 |
| 23 | 25.3 |

As examples of the tubes that may be used for different currencies of the following are given:

| COUNTRY | SWITZERLAND | | |
|---|---|---|---|
| COINS | 10c. | 50c. | 20c. |
| TUBE SET | 4 | 4 | 3 |
| HEIGHT (h) | 2.1 | 1.95 | 2.43 |

| COUNTRY | WEST GERMANY | | |
|---|---|---|---|
| COINS | 10pf. | 50pf. | 1 DM |
| TUBE SET | 2 | 3 | 2 |
| HEIGHT (h) | 2.3 | 2.18 | 2.38 |

| COUNTRY | NORWAY | | |
|---|---|---|---|
| COINS | 50ϕ | 25ϕ | 1kr. |
| TUBE SET | 2 | 5 | 1 |
| HEIGHT (h) | 2.33 | 2.0 | 2.46 |

Where (h) is the height of the lower end of the tube above the lower wall of the channel on the assembled dispenser.

All dimensions are in millimeters.

We claim:

1. A coin dispenser comprising:

(a) a substantially horizontally extending channel of shallow cross-section, (b) an upright coin tube extending down through an opening in the upper wall of the channel, (c) an aperture in the lower wall of the channel offset from the axis of the coin tube, (d) an apertured slide plate mounted for reciprocating movement in the channel between a position in which the slide plate's aperture is below the coin tube and a position in which the slide plate's aperture is above the aperture in the lower wall, (e) a mounting member fixed vertically with respect to the substantially horizontally extending channel, (f) a plurality of deformed pegs carried by the coin tube, and (g) vertically elongated slots in the mounting member for receiving the deformed pegs, the deformation of the pegs locking the lower end of the coin tube at a predetermined height above the lower wall of the channel, said predetermined height being slightly greater than the thickness of the denomination dispensed by the tube.

2. A coin dispenser according to claim 1 in which several such channels are arranged side-by-side, each channel having an upright coin tube extending down through an opening in the upper wall of the channel, an aperture in the lower wall of each channel offset from the axis of the coin tube, and an apertured slide plate mounted for reciprocating movement in each channel between a position in which the slide plate's aperture is below the coin tube and a position in which the slide plate's aperture is above the aperture in the lower wall, a mounting member fixed vertically with respect to the horizontally extending channels, a plurality of deformed pegs carried by each coin tube, and vertically elongated slots in the mounting member for receiving the deformed pegs of each coin tube, the deformation of the pegs locking the lower end of each coin tube at a respective predetermined height above the lower wall of the respective channel.

3. A coin dispenser according to claim 1 or 2 in which the mounting member comprises an upright plate secured to the channels.

4. A coin dispenser according to claim 3 in which the assembly of upright plate and coin tubes is positioned with respect to the channels by protruding studs which are received by close fitting holes in the upright plate.

5. A coin dispenser according to claim 1 or 2 in which the tube or tubes are selected from a range of standard sizes of tubes.

6. A coin dispenser according to claim 3 in which the tube or tubes are selected from a range of standard sizes of tubes.

7. A coin dispenser according to claim 4 in which the tube or tubes are selected from a range of standard sizes of tubes.

8. A coin dispenser according to claim 1 or 2, wherein the deformed pegs substantially fill the slots.

9. A coin dispenser comprising:

(a) A plurality of upright coin holders for different respective coin denominations, each adapted to hold a plurality of coins in a stack, (b) coin support means located opposite the lower open ends of the coin holders to receive from each coin holder the coin at the open end of that coin holder, (c) an edge portion of each coin holder, and said coin support means, defining between them a gap between one and two coin thicknesses for the coin denomination concerned, through which the bottom coin concerned can be shifted edgewise, (d) means for shifting coins edgewise through said gaps, and (e) means for securing the coin holders relative to said support means such that the gaps are set according to the denomination concerned, said securing means comprising (i) a plurality of deformed pegs carried by each coin holder and received by (ii) slots in a mounting member, said slots being elongated in a direction substantially perpendicular to the coin support means, the deformation of the pegs on each holder locking that holder in a position that yields the desired gap for that holder.

10. A coin dispenser according to claim 9, wherein the deformed pegs substantially fill the slots.

11. A coin dispenser according to claim 1 or 2 or 9, wherein the deformed pegs are integral with the tube or each tube.

12. A coin dispenser according to claim 7, wherein the deformed pegs are integral with the tube or each tube.

13. A coin dispenser according to claim 1 or 2 or 9, wherein the tube or each tube has two pairs of deformed pegs.

14. A coin dispenser according to claim 12, wherein the tube or each tube has two pairs of deformed pegs.

15. A coin dispenser according to claim 8 or 10, wherein both ends of each slot are closed.

16. A coin dispenser according to claim 14, wherein both ends of each slot are closed.

17. A coin dispenser according to claim 16, wherein each pair of deformed pegs is integrally attached to a flat bearing surface on the tube or each tube.

* * * * *